US005492497A

United States Patent [19]

Brooke et al.

[11] Patent Number: 5,492,497

[45] **Date of Patent: *Feb. 20, 1996**

[54] SUBLIMABLE PARTICLE BLAST CLEANING APPARATUS

[75] Inventors: Robert K. Brooke, Snellville; Robert W. Schmucker; Joseph J. Schmucker, both of Warner Robins, all of Ga.

[73] Assignee: Tomco$_2$ Equipment Company, Loganville, Ga.

[ * ] Notice: The term of this patent shall not extend beyond the expiration date of Pat. No. 5,415,584.

[21] Appl. No.: 306,990

[22] Filed: Sep. 16, 1994

Related U.S. Application Data

[63] Continuation-in-part of Ser. No. 124,712, Sep. 21, 1993, Pat. No. 5,415,584.

[51] Int. Cl.$^6$ ..... B08B 7/00

[52] U.S. Cl. ..... 451/99; 451/90; 451/91; 451/38; 451/39; 134/7

[58] Field of Search ..... 451/38, 39, 40, 451/75, 90, 91, 96, 94, 99, 100, 101, 102; 137/7, 11, 12, 13

[56] References Cited

U.S. PATENT DOCUMENTS

| | | | |
|---|---|---|---|
| 561,483 | 6/1896 | Bryce . | |
| 2,421,753 | 6/1947 | Joyce . | |
| 3,110,983 | 11/1963 | Moore | 51/9 |
| 3,137,101 | 6/1964 | Leliaert | 51/13 |
| 3,160,993 | 12/1964 | McCormick | 51/9 |
| 3,272,396 | 9/1966 | Neville | 22/194 |
| 3,933,165 | 1/1976 | Budzak et al. | 137/625.48 |
| 4,333,277 | 6/1982 | Tasedan | 51/425 |
| 4,339,897 | 7/1982 | Thompson et al. | 51/436 |
| 4,617,064 | 10/1986 | Moore | 451/39 |
| 4,655,847 | 4/1987 | Ichinoseki et al. | 51/410 |
| 4,744,181 | 5/1988 | Moore et al. | 51/436 |
| 4,947,592 | 8/1990 | Lloyd et al. | 51/436 |
| 4,977,910 | 12/1990 | Miyohara et al. | 51/320 |

FOREIGN PATENT DOCUMENTS

| | | |
|---|---|---|
| 79693 | 5/1918 | Switzerland . |
| 565260 | 6/1944 | United Kingdom . |

*Primary Examiner*—Bruce M. Kisliuk
*Assistant Examiner*—Eileen P. Morgan
*Attorney, Agent, or Firm*—Deveau, Colton & Marquis

[57] ABSTRACT

A particle blast cleaning apparatus for use with sublimable blast media, a source of compressed gas, and a discharge nozzle. The apparatus includes a mixing device for mixing the sublimable media with compressed gas, which mixing device includes a lower section having an outlet port formed therein and an upper section positioned over the lower section and having two sublimable media inlet ports and a compressed gas inlet port. A transfer member is mounted between the lower section and the upper section for reciprocal movement and has at least two transfer chambers for transporting sublimable media.

19 Claims, 6 Drawing Sheets

SUBLIMABLE PARTICLE BLAST CLEANING APPARATUS

CROSS-REFERENCE TO RELATED APPLICATIONS

The present application is a continuation-in-part of Application Ser. No. 08/124,712 filed on Sep. 21, 1993, now U.S. Pat. No. 5,415,584.

TECHNICAL FIELD

The present invention relates to a particle blast cleaning apparatus and more particularly to an apparatus for use with sublimable particles.

BACKGROUND OF THE INVENTION

Particle blast cleaning apparatuses are well known in the an and it is known to use various types of blast media, such as ordinary sand, tiny glass beads, walnut shells, peanut husks, etc. One difficulty with these types of media is that the spent media can be difficult and time consuming to clean up.

At least partially due to the difficulty of gathering and disposing of the spent media, the art has turned to the use of sublimable particles as a blast media. Specifically, it has become known that carbon dioxide ($CO_2$)ice(i.e., "dry ice") can be used as a blast media. Dry ice, being in solid form, acts as a good abrasive media. After being spent during the cleaning operation, the dry ice simply evaporates and leaves nothing to be cleaned up other than the residue which has been abraded from the surface of the object being cleaned. This substantially reduces the task of cleaning up after the blast cleaning operation. Unfortunately, dry ice exists at extremely low temperatures, such as below more than −100° F. This proves to present certain practical difficulties when the extremely cold blast media is used in the blast equipment. The dry ice rapidly absorbs heat from the surrounding equipment, thereby substantially lowering the temperature of the equipment. This can result in the formation of ice condensation on the outside or inside of the equipment and can, through thermal contraction, substantially change the dimensions of critical components of a device.

Various efforts have been made in the art to provide a workable sublimable media blast cleaning apparatus. One of the difficulties encountered in the art is reliably introducing or entraining dry ice particles in a fast flowing stream of propellant gas. In general, two arrangements are typical in the art. In one arrangement, a rotary pellet transport arrangement introduces dry ice pellets into a high pressure gas stream through the use of a discharge nozzle. Such an arrangement is generally disclosed in U.S. Pat. No. 4,617,064 of Moore. In a typical rotary arrangement, cavities formed in a rotating member are filled with dry ice pellets at a receiving station and transported to the discharge station where they are entrained in the propellant gas stream. Another such rotary arrangement is shown in U.S. Pat. No. 4,947,592 of Lloyd et al. Rotary-feed devices are particularly prone to "freeze-up", a phenomenon common in applications involving low temperature dry-ice media, wherein thermal contraction and frozen condensate prevent the device's moving parts from operating as intended.

In another type of arrangement known in the art, a plurality of feeder bars move back and forth in linear fashion to collect dry ice pellets and transport them from an inlet to an outlet where they are entrained in the high speed gas flow. Such an arrangement is shown in U.S. Pat. No. 4,741,181 of Moore, et al. The '181 Moore, et al. arrangement generally suffers from having a large number of moving parts, thereby being rather complex. Because of the low temperatures attendant upon the use of dry ice, mechanical complexity should be avoided in order to maintain good reliability.

In general, among the problems experienced in the art are: (1) maintaining a relatively uniform and reliable flow of dry ice particles; (2) evenly mixing the dry ice particles with the flow of compressed gas; and (3) providing a device that operates reliably without "freeze up". It is to the provision of such an apparatus that overcomes these problems that the present invention is primarily directed.

SUMMARY OF THE INVENTION

Briefly described, in a preferred form the present invention comprises an apparatus for particle blast cleaning, and in particular, for use with sublimable particle media. The apparatus includes a hopper for storing and providing a supply of dry ice pellets and a device for entraining the dry ice pellets within a compressed gas propellant stream flowing from a suitable source of compressed gas, such as a compressor, gas supply or vaporized inert cryogen.

The device includes first and second dry ice inlets and a compressed gas inlet. A slide bar is mounted for reciprocal movement relative to these dry ice inlets and the compressed gas inlet so as to selectively align one of a plurality of transfer chambers formed in the slide bar with the dry ice inlet ports or the compressed gas inlet port. Preferably, the compressed gas inlet port is positioned inbetween the two dry ice inlet ports so that, in operation, as the slide bar reciprocates back and forth, a charge of dry ice pellets is entrained in the compressed gas each time one of the transfer chambers becomes aligned with the compressed gas inlet port. This results in relatively smooth flow of the dry ice pellets, resulting in improved blast cleaning.

The apparatus preferably includes pneumatic control circuits which enable the device to be switched from "air-only" mode to "air-plus-$CO_2$-pellets" mode. Pneumatic controls may likewise be provided to adjust the stroke speed of the reciprocating slide bar. Control pneumatics preferably enable pressure adjustment at both the compressed gas inlet port, and at the delivery nozzle. The advantage of this arrangement is that it minimizes propellant gas consumption and allows for operation of the device through a wide range of propellant gas supply pressures.

The mixing device preferably also includes an improved dynamic seal. Preferably, the dynamic seal comprises upper and lower bearing strips placed above and below the slide bar. These bearing strips are held snugly against the slide bar by means of a movable upper block assembly which is held down by a plurality of air cylinders. The air cylinders tend to gently squeeze the bearing strips against the transfer bar, thereby providing good sealing, good alignment, and good beating action. This design also has the advantages of automatically compensating for wear in the bearing material, and allowing adjustment of the clamping force, thus enabling operation over a wide range of operating pressures.

Preferably, the compressed gas is compressed air. However, in some operating environments, nitrogen gas, or other gas, may be cheaper and/or more readily available.

Accordingly, it is an object of the present invention to provide an improved particle blast cleaning apparatus which is simple in construction, durable in use, and economical in manufacture.

It is another object of the present invention to provide an improved particle blast cleaning apparatus which achieves relatively uniform flow of media.

It is another object of the present invention to provide an improved particle blast cleaning apparatus which is extremely durable in use, despite the relatively rigorous demands placed upon the apparatus by the use of dry ice as the media.

These and other objects, advantages, and features of the present invention will become apparent to those skilled in the art upon reading the following specification in conjunction with the accompanying drawings.

BRIEF DESCRIPTION OF THE DRAWING FIGURES

DETAILED DESCRIPTION

Figure 1:
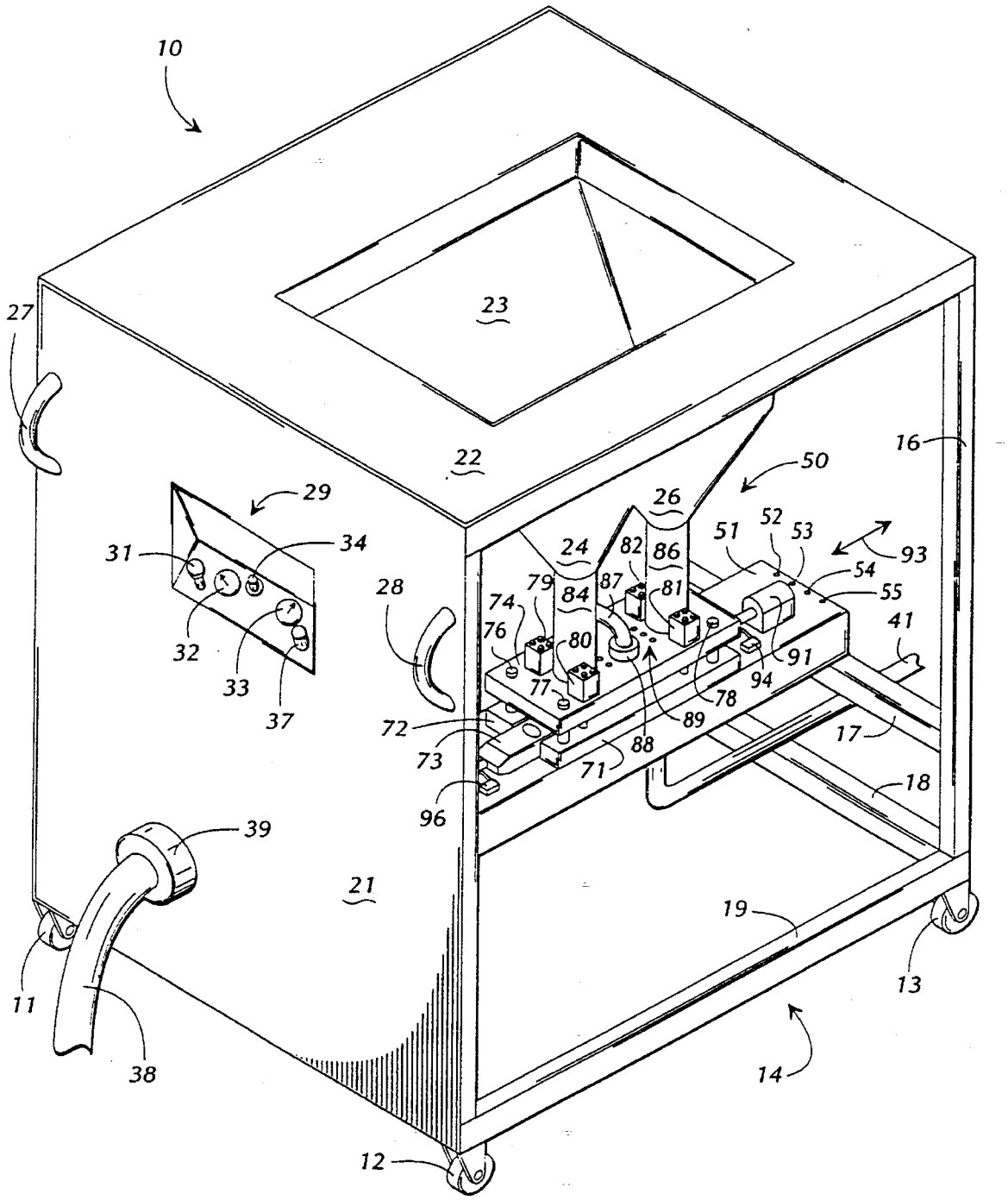
FIG. 1 is a perspective, schematic illustration of a particle blast cleaning apparatus according to a preferred form of the invention.

Referring now in detail to the drawing figures, wherein like reference numerals represent like parts throughout the several views, FIG. 1 schematically depicts a blast cleaning apparatus 10 for use with sublimable media according to a preferred form of the invention. The apparatus 10 preferably can be made on a portable frame, as shown, including ground engaging casters, such as casters 11, 12, and 13, for supporting a support frame assembly 14 above the ground or the floor. The support frame assembly 14 as depicted preferably can include upright stanchions and lateral beams 16, 17, 18, and 19 constructed of rectangular steel tubing. Of course, other well-known construction techniques are possible.

External panels, such as panel 21 and top panel 22, are secured to the support frame assembly with suitable fasteners (unshown). These removable panels provide easy access to the working components of the apparatus 10 for service and repair. In FIG. 1, two of the side panels and one of the end panels are not illustrated in order to show the details of the operative portion of the device. Also not shown is a hinged lid for coveting the large hopper 23, which hopper is provided for storing a suitable quantity of dry ice (solid $CO_2$ ) pellets. The hopper 23 converges to two (2) discharge cones 24 and 26. Dry ice pellets flowing from the interior of the hopper 23 through the discharge cones 24 and 26 are fed into the mixing apparatus, which will be described in more detail below.

The apparatus includes two large handles 27 and 28 for moving the apparatus about and a recessed control panel 29 positioned in the end panel 21. The control panel 29 includes a push valve 31 for switching between compressed air only and compressed air mixed with dry ice pellets. The control panel also includes a main air pressure gauge 32 and a control air pressure gauge 33. An on/off switch 34 is centrally locate& A rotary valve 37 is provided for adjusting the speed of the stroke of air cylinders in the mixing apparatus, thereby controlling the rate of pellet discharge.

As depicted in FIG. 1, the apparatus 10 is supplied with compressed gas from a suitable source, such as an air compressor, through a large supply hose 38 connected to the apparatus via a coupling 39. After dry ice pellets are entrained in the compressed gas, the mixture of compressed gas and dry ice pellets is delivered to an unshown nozzle or gun through delivery conduit 41.

The apparatus 10 also includes a mixing device indicated generally at 50. The mixing device 50 is mounted to the support frame assembly 14 and positioned beneath the hopper 23. The mixing device 50 includes a rectangular platform or support deck 51 extending between beam 17 and an unshown beam at the opposite end of support frame assembly 14. The platform or deck 51 can be secured to the beam 17 by well known techniques, such as welding or, as in the case depicted in FIG. 1, by fasteners 52–55. The platform or deck 51, may be fabricated from standard structural materials, such as steel or aluminum channel stock. The platform 51 should be of sufficient rigidity to withstand the weight and mechanical forces imposed by the mixing device without significant deflection.

A pair of intermediate bolster blocks or side rails 71 and 72 are formed in or otherwise secured to the deck 51 and extend generally parallel to each other along a portion of the length of the deck 51. By virtue of the intermediate blocks 71 and 72 being spaced apart from one another, a channel is formed between them for receiving a transfer bar 73. Positioned above the transfer bar 73 and the intermediate blocks 71 and 72 is an upper plate or upper section 74. The upper plate 74 is secured to the deck 51 and the intermediate blocks 71 and 72 by four guide pins, such as guide pins 76, 77, and 78. These guide pins ride in close-fitting bores formed in the upper plate 74 and allow the upper plate 74 to be moved up and down while maintaining close registration of the upper plate 74 relative to the intermediate blocks 71 and 72. The upper plate 74 is urged or biased downwardly toward the deck 51 and the intermediate blocks 71 and 72 by four air cylinders, such as air cylinders 79, 80, 81, and 82. Together, the guide pins and the air cylinders provide part of a dynamic seal which will be discussed in more detail later in the specification.

A pair of dry ice inlet conduits 84 and 86 extend between the discharge cones 24 and 26 of the hopper 23 and the upper plate 74. A compressed air supply line 87 is coupled to the upper plate 74 with a coupling 88.

Two triplets of air pressure relief vents, such as triplet 89, are formed in the upper plate 74 for relieving or venting air pressure that may be otherwise trapped in the transfer chambers (to be discussed later) in the transfer bar 73.

A pair of air cylinders 91 and 92 (see FIG. 3) are coupled to the ends of the transfer bar 73 for pulling the transfer bar back and forth in the direction of double-headed direction arrow 93 (FIG. 1 ). Limit valves 94 and 96 are positioned generally adjacent the air cylinders 91 and 92 for detecting the desired ends of the stroke of the transfer bar 73 so as to reverse direction. In this regard, it should be understood that the air cylinders 91 and 92 are each operated in a "pull" mode only. It is considered that by pulling only with each cylinder, better alignment of the transfer bar 73 within its travel path can be obtained, thereby minimizing wear and tear on the various components. Alternatively, only one cylinder could be provided and operated in a "push-pull" mode. Optionally, one can provide guide rollers (unshown) to help keep the transfer bar aligned along the desired path of movement.

Figure 2:
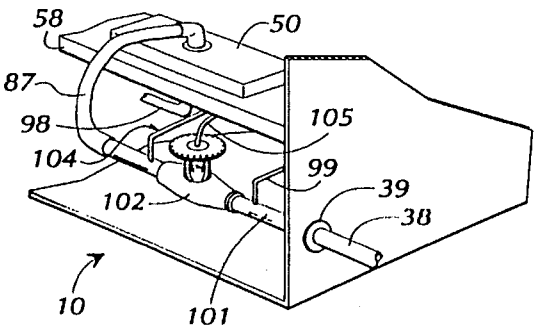
FIG. 2 is a perspective, schematic view of a portion of the apparatus of FIG. 1.
Figure 7:
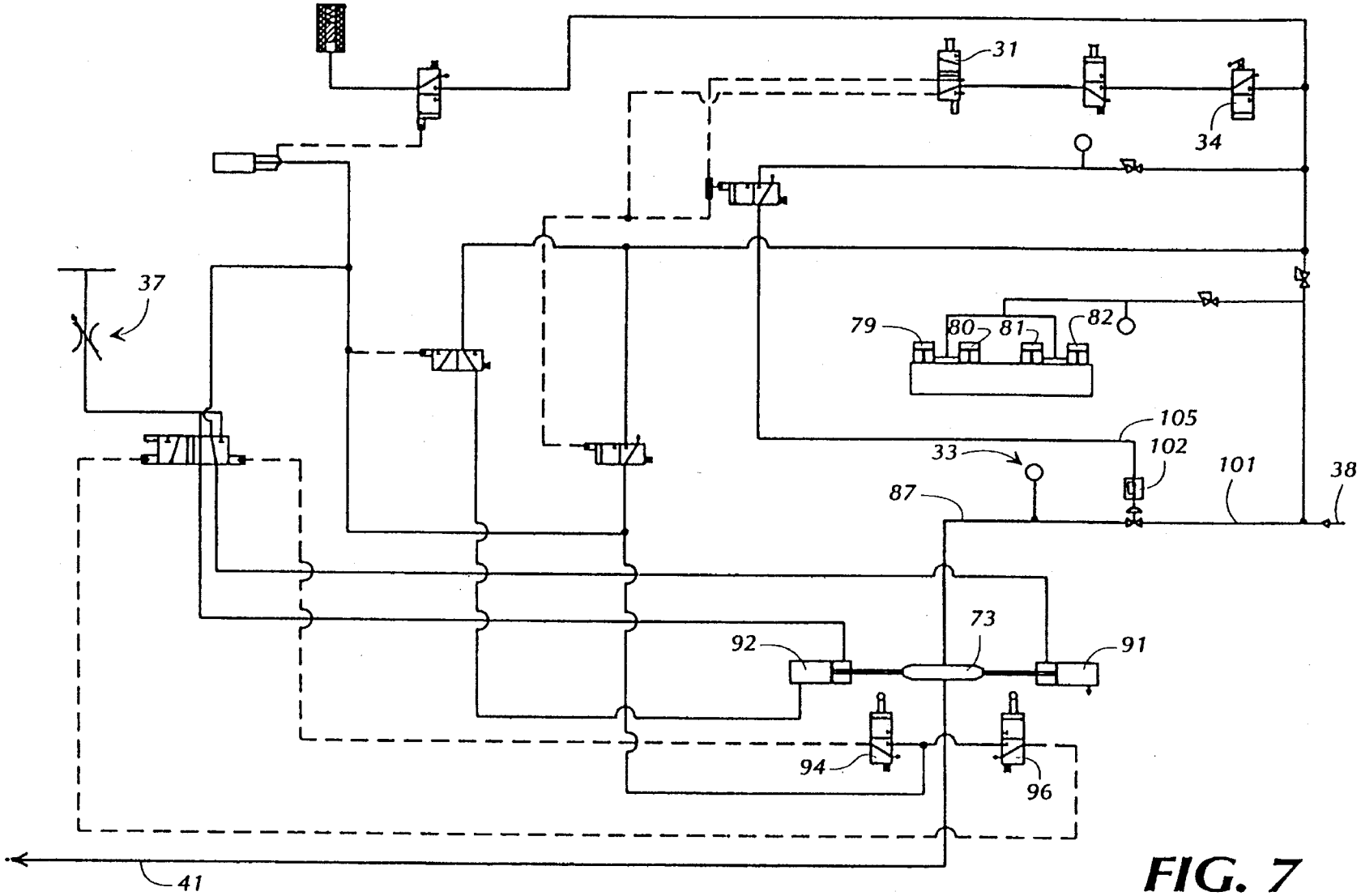
FIG. 7 is a schematic diagram of the gas-flow and pneumatic control systems of the apparatus of FIG. 1.

Referring again to FIG. 2, some details of the air supply plumbing will be considered. (A schematic diagram of the air-flow piping and the control pneumatics is shown by FIG. 7.) As previously described, the main supply of air to the apparatus 10 is provided through supply hose 38 connecting with coupling 39. Internally of the apparatus, this high pressure air is communicated through a first hose 101 to a globe valve 102. Output from globe valve 102 is routed to compressed air supply line 87 which feeds the mixing device 50 with compressed air. Push valve 31 operates to switch the device between an "air-only" mode, wherein dry ice is not introduced into the mixing device, and the "air-plus-$CO_2$-pellets" mode. Push valve 31 operates to pneumatically control a dry ice delivery enable valve, which alternatively enables or disables the mixing device 50. Globe valve 102 is controlled by a pneumatic control line 105. By throttling the incoming compressed air to a pressure suitable for feeding the mixing device 50, globe valve 102 enables the device to operate over a wide range of supply pressures.

Figure 3:
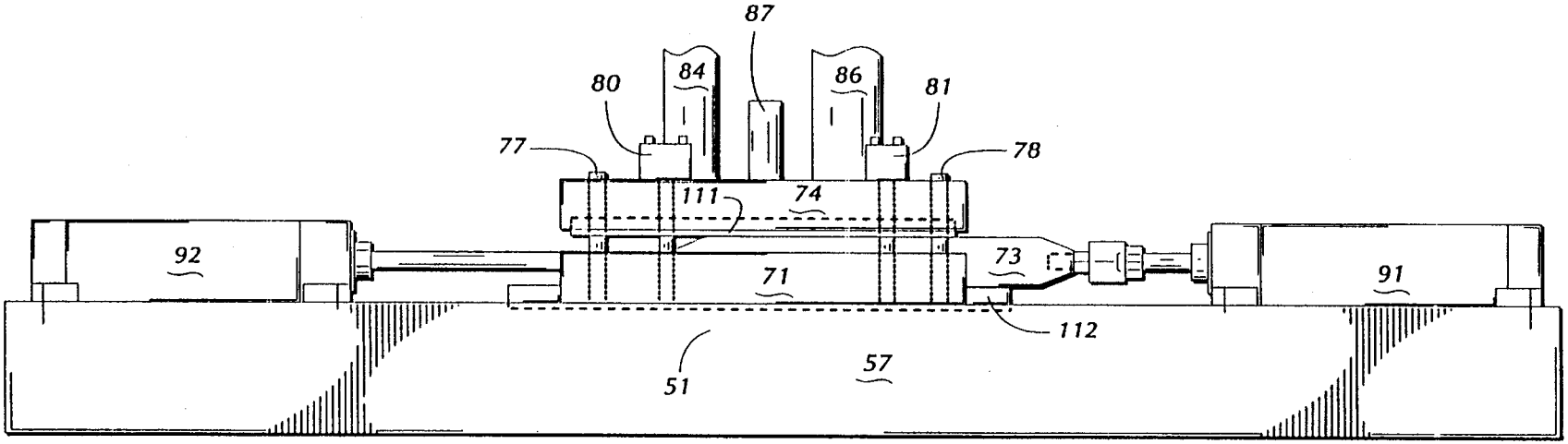
FIG. 3 is a schematic, side elevation view of a portion of the apparatus of FIG. 1.

Referring again specifically to FIG. 3, the details of the dynamic seal can be more fully considered. As previously described, the upper plate 74 is movably located above the deck 51 and the intermediate blocks 71 and 72 (72 unshown in FIG. 3) by means of guide pins, such as guide pins 77 and 78, and clamping air cylinders, such as air cylinders 80 and 81. FIG. 3 further shows the use of sealing strips or bearing strips, such as upper bearing strip 111 and lower bearing strip 112. These bearing strips 111 and 112 straddle the transfer bar 73 so that as the clamping air cylinders squeeze the upper plate toward the deck 51, the bearing strips 111 and 112 snugly engage the transfer bar 73 to provide a fluid seal. The beating strips, which are subjected to extremely low temperatures in operation of the device, preferably are made from self-lubricating material. Preferably, this self-lubricating bearing material is of a plastic or composite non-ferrous composition. The transfer bar 73 is specially treated for long wear by hard anodized treatment wherein a Teflon® supplementary impregnation is provided. The dynamic seal constantly adjusts for dimensional changes in the unit as the apparatus goes from ambient temperature to operating temperatures (which are quite low). This helps to keep the seal intact and to facilitate the induction of the pellets into the air stream, while keeping foreign matter out of the operating mechanism. This results in an extremely long-wearing seal. Preferably, pressure supplied to the air cylinders can be adjusted or regulated as conditions warrant. See FIG. 7.

Figure 4A:
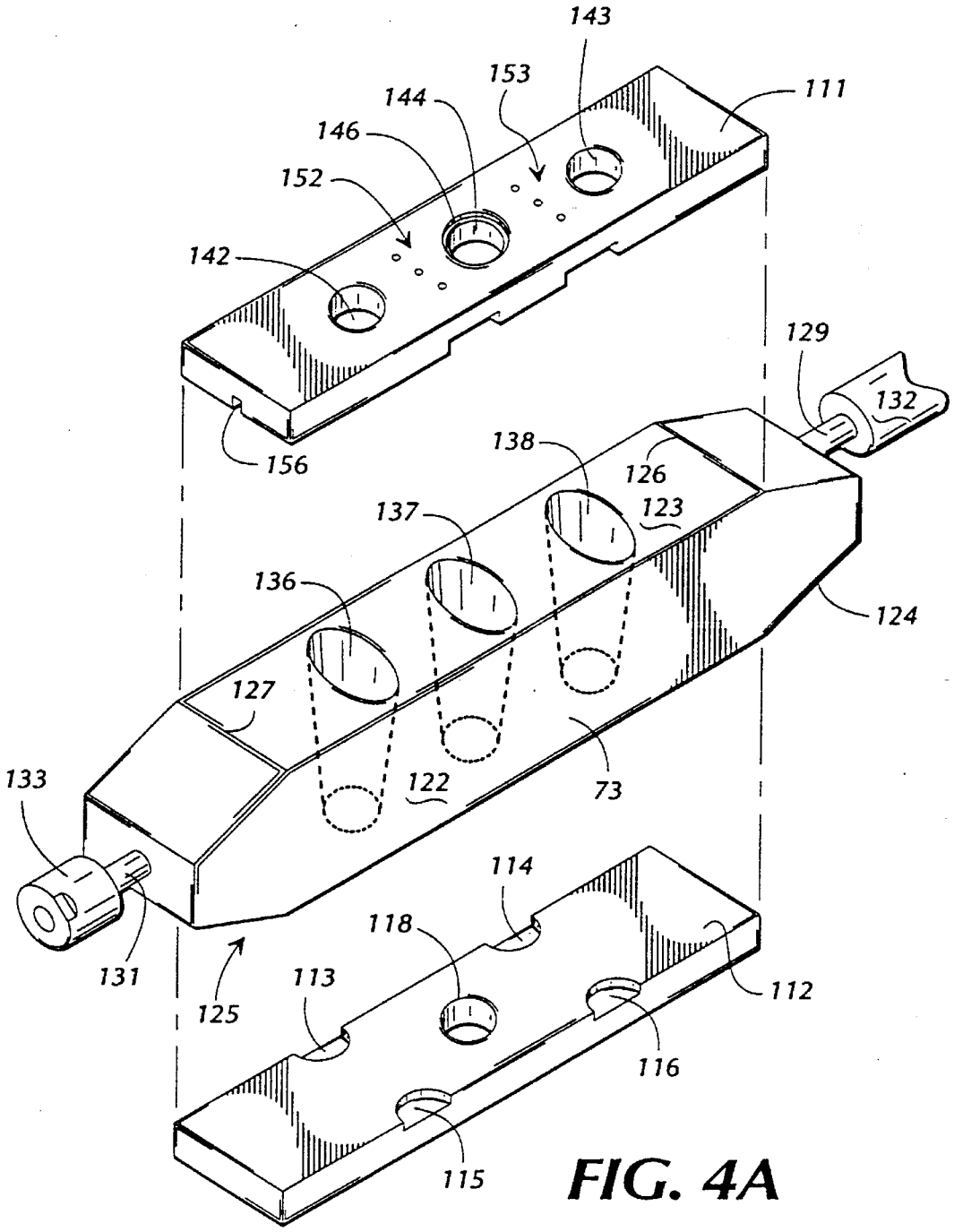
FIG. 4A is a schematic, exploded view of a portion of the apparatus of FIG. 1.

Details of the upper bearing strip 111 and the lower bearing strip 112 can be seen in FIG. 4A. In FIG. 4A, the bearing strips 111 and 112 and the transfer bar 73 are depicted in an exploded view substantially as in the arrangement in which they are placed in the assembled device (with the exception of these items being depicted apart from one another). The lower strip 112 and the upper strip 111 are in the form of relatively thin rectangular strips of bearing material. Bearing strips 111 and 112 maybe affixed to upper plate 74 and deck 51 respectively by means of fasteners, adhesives, or preferably by fitting bearing strips 111 and 112 into mortised slots machined into upper plate 74 and deck 51. A large outlet port 118 is provided roughly in the middle of the bearing strip 112. When the bearing strip 112 is installed, the outlet port 118 is vertically aligned with the compressed air inlet 87 so that the compressed air may be passed through the transfer bar 73 and out through the outlet port 118. Four vent grooves 113–116 are provided on bearing strip 112 to relieve unwanted pressure from the transfer chambers (to be discussed later) to facilitate the filling of the chambers with dry ice pellets.

Now considering the transfer bar 73, one can see that it is an elongate, substantially rectangular cross-section, solid block of material, preferably machined from aluminum and then hard coat anodized and Teflon® impregnated. Alternatively, the transfer bar 73 could be cylindrical and could ride in a smooth bore. The four longitudinal exterior faces, such as faces 122 and 123, are perpendicular to adjacent ones of each other. The ends, 124 and 125, of the transfer bar are chamfered. Alternately, these could be smoothly rounded to avoid a sharp edge, such as the sharp edges 126 and 127. Swivel-ended threaded studs 129 and 131 are threaded into the ends of the transfer bar 73. The ends of these swivel studs are received in swivel sockets 132 and 133. In turn, these swivel sockets are threaded for receiving the piston rods of the air cylinders 91 and 92 (see FIG. 3).

The transfer bar 73 includes three transfer chambers or transfer passageways 136, 137, and 138. More transfer chambers could be provided. These passageways extend from the upper surface 123 completely through the transfer bar 73 to the opposite face. As is depicted in FIG. 4A, these transfer chambers taper from a generally football-shaped or ovoid-shaped top to a circular or round-shaped bottom. The advantage of this tapered arrangement is that it facilitates the introduction of dry ice pellets into the chamber. In applications where extremely gentle blasting is desired, one can eliminate the taper in the transfer bar transfer chamber so that only smaller amounts of dry ice pellets are introduced into the transfer chamber, thereby decreasing the amount of abrasive media delivered. Alternatively, the thickness of the transfer bar may be varied to adjust the quantity of dry ice contained by the transfer chambers. Looking at the ovoid or football-shaped openings, the minor axis thereof closely corresponds to the diameter of the outlet port 118 and the inlet port, to be discussed below, of the upper bearing strip 111.

The upper bearing strip 111, shown in its installed orientation in FIG. 4A, is a thin, rectangular strip of bearing material, as previously describe& The upper bearing strip 111 includes first and second dry ice inlet ports or apertures 142 and 143. A compressed air inlet port 144 is positioned between the dry ice inlet ports 142 and 143. The compressed air inlet port 144 is provided with a recess or counterbore 146 for receiving an O-ring for sealing the compressed air inlet port 144 to the upper plate 74. The upper bearing strip 111 is secured to the upper plate 74 by fasteners, adhesive, or preferably by fitting bearing strip 111 into a mortise machined into upper plate 74. Alternatively, the upper and lower bearing strips 111 and 112 can be made to have a T-shape cross section and then secured in T-slots formed in the upper plate and in the deck.

Figure 4B:
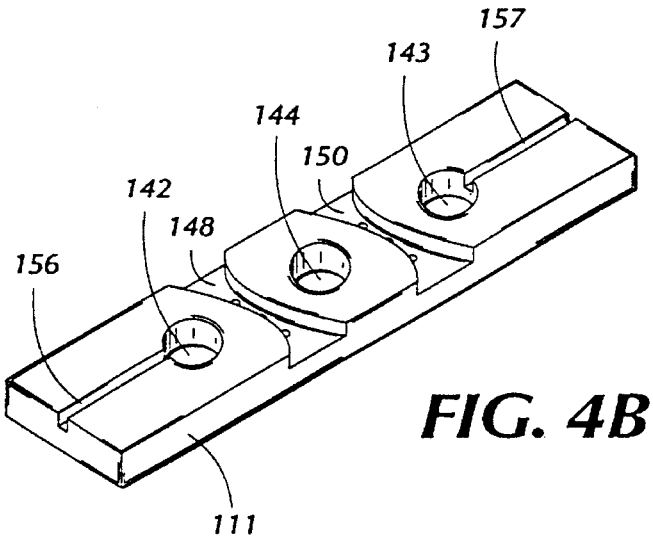
FIG. 4B is a perspective illustration of a portion of the apparatus of FIG. 4A, with the portion shown in FIG. 4B illustrated upside down to show additional details.

The upper bearing strip 111 also includes two triplets 152 and 153 of small air pressure relief vents for relieving unwanted pressure from within the transfer chambers 136, 137, and 138. Also, the upper bearing strip 111 includes longitudinal pressure relief channels 156 and 157, and transverse pressure relief channels 148 and 150, formed in the underside portion of the upper bearing strip 111, as depicted in FIG. 4B. In FIG. 4B, the upper bearing strip 111 is shown mined upside down to reveal the details of the longitudinal and transverse pressure relief channels. The channels 148, 150, 156, and 157 vent unwanted pressure from the transfer chambers, when the transfer chambers individually are in fluid communication with the dry ice inlet ports 142 and 143, by communicating unwanted pressure away from the transfer chambers.

Figure 5:
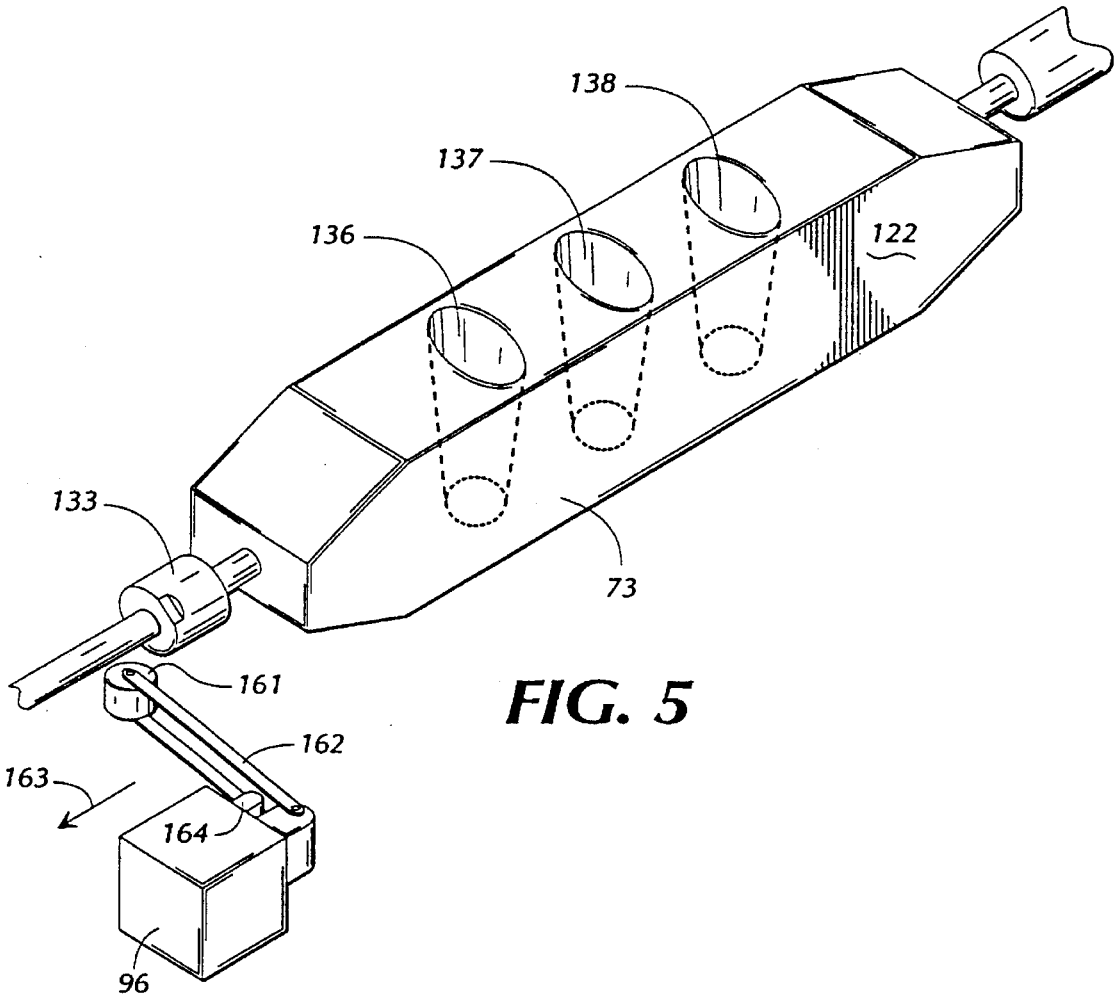
FIG. 5 is a schematic illustration of a transfer bar portion of the apparatus of FIG. 1, shown in conjunction with a limit valve.

FIG. 5 shows the interaction of the limit valves, such as limit valve 96, with the transfer bar 73. When the transfer bar 73 moves the desired stroke to the left, a front face of the swivel socket 133 contacts a roller 161 of the limit valve 96, thereby moving the roller and the arm 162 to which it is attached in the direction of direction arrow 163. This causes switch button 164 to be depressed which creates a signal which is used to trigger the shutting off of air pressure to air cylinder 92 to stop this air cylinder from continuing to pull the transfer bar in this direction. At the same time, air pressure is communicated to air cylinder 91 to cause it to pull the transfer bar in the opposite direction. Limit valve 94 (unshown in FIG. 5) operates in substantially the same manner to control travel toward air cylinder 91 and to reverse the direction yet again. Alternatively, electromagnetic limit switches may be substituted for the mechanical switching valves described above.

FIG. 7 depicts pneumatic control circuits which facilitate the operation of the apparatus. For example, as depicted in FIG. 7, the device may be switched from an "air-only" mode to an "air-plus-$CO_2$-pellets" mode. Also, the pneumatics allow the stroke speed (rate) of the reciprocating slide bar to be adjusted. Further, the control pneumatics allow adjustment of the pressure at both the compressed gas inlet port and the delivery nozzle. Moreover, pressure supplied to the clamping air cylinders can be regulated.

Figure 6A:
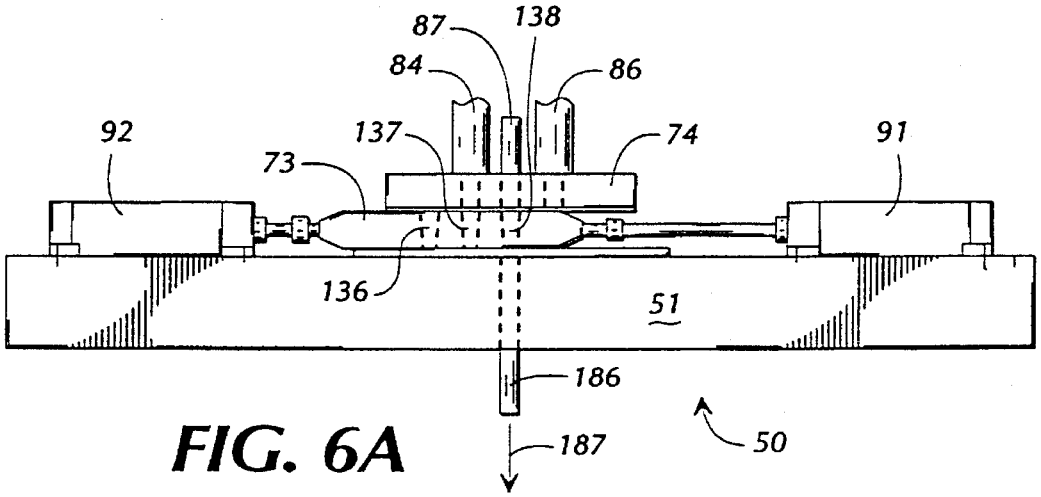
FIGS. 6A through 6C are schematic, side elevation views of a portion of the apparatus of FIG. 1 depicting one half cycle of movement of the transfer bar portion of the apparatus.
Figure 6B:
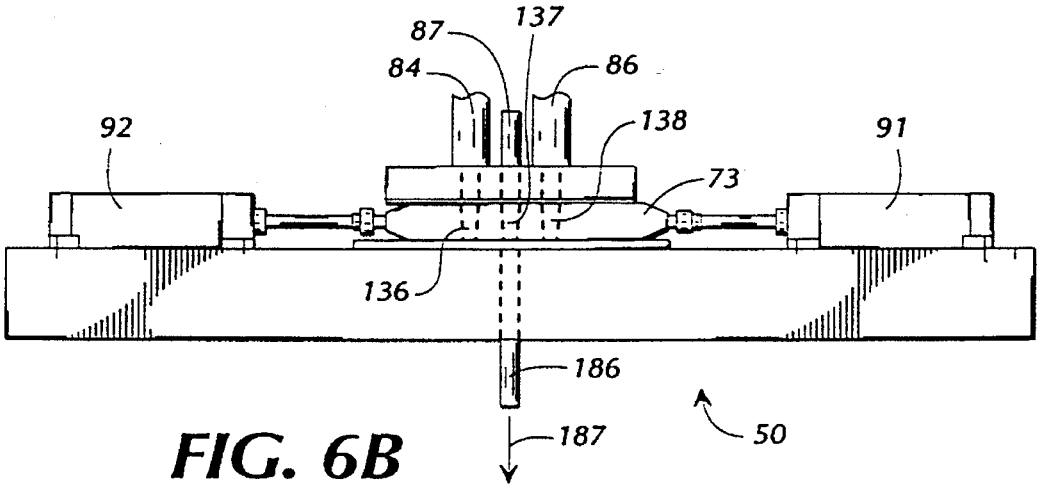
Figure 6C:
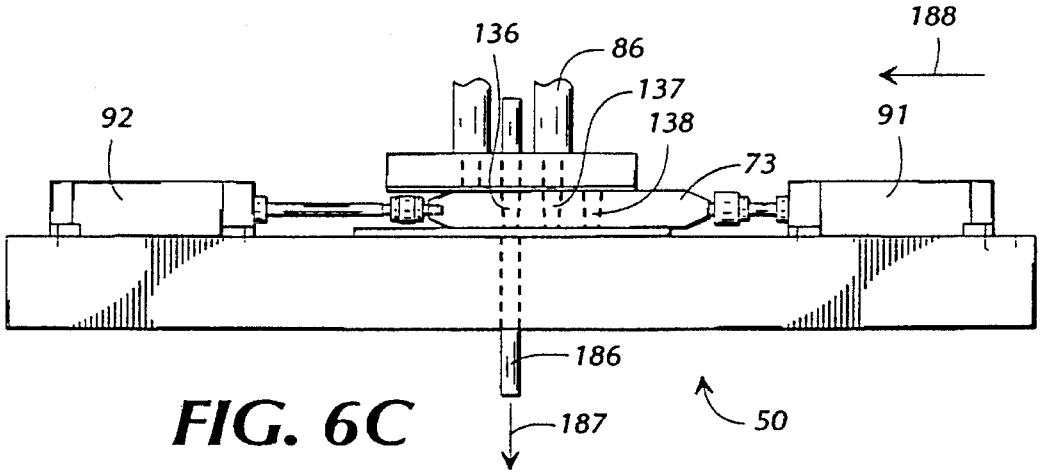

Having now described the structural details of the preferred embodiment, attention is turned to the operation of the device as depicted in FIGS. 6A–6C. FIGS. 6A, 6B, and 6C show, respectively, the configuration of the mixing device 50 as transfer bar 73 moves from a first position to a second position and then to a third position. It is to be understood that in operation the transfer bar 73 would then move from the third position back to the second position and to the first position to complete the cycle. Thus, FIGS. 6A through 6C depict one half-cycle of operation of the mixing device 50.

In FIG. 6A, the transfer bar 73 is in its left-most position. In this first position, the transfer chambers 136, 137, and 138 are positioned such that transfer chamber 136 is not in communication or registration with dry ice inlet conduit 84 or dry ice inlet conduit 86 or compressed air supply line 87. Rather, transfer chamber 137 is in registration with dry ice inlet conduit 84 for receiving a charge of dry ice pellets, while transfer chamber 138 is in registration with compressed air supply line 87 and an outlet conduit 186. In this position, a charge of dry ice pellets previously loaded into the transfer chamber 138 is entrained in and mixed with a blast of compressed air flowing through the compressed air supply line 87 through the upper plate 74, the transfer bar 73, and out through the deck 51. In this regard, the dry ice pellets and the compressed air move in the direction of direction arrow 187.

FIG. 6B shows the transfer bar 73 in a second position in which transfer chamber 136 receives a charge of dry ice pellets from dry ice conduit 84, while transfer chamber 137 is cleared of dry ice pellets by entraining the dry ice pellets in a blast of compressed air flowing from the compressed air supply line 87 through the mixing device 50 and out through the outlet 186. Meanwhile, transfer chamber 138 is positioned in registration with dry ice inlet conduit 86 for receiving a charge of dry ice pellets.

Referring now to FIG. 6C, a third position in the half-cycle of operation is depicted in which the transfer chamber 136 is evacuated of dry ice pellets, while the middle transfer chamber 137 receives a fresh charge of dry ice pellets and the remaining transfer chamber 138 is positioned to neither receive nor discharge dry ice pellets. After this, the transfer bar 73 goes back to the left in the direction of direction arrow 188 so that after the discharge of pellets from transfer chamber 136, transfer chambers 137 and 138 are subsequently evacuated and the dry ice entrained in the blast of compressed air. This reciprocal motion takes place at a controllable rate. The back and forth motion generates heat, despite the self-lubricated wear blocks, which helps to keep the device from freezing up (seizing).

It should be readily apparent to those skilled in the art that the air cylinders 91 and 92, which are operated in pull only modes, are operated sequentially so that the transfer bar 73 is pulled first in one direction and then pulled back in the opposite direction in a repeated fashion to provide a reciprocating motion.

In reviewing the present disclosure, it should be readily apparent to one skilled in the art that the use of two air cylinders 91 and 92 is not absolutely necessary and that one air cylinder can be used instead. Also, while compressed air is normally contemplated as the compressed gas, in many situations compressed nitrogen, carbon dioxide, or other readily available gas is suitable.

Those skilled in the art will recognize that the invention according to the present disclosure does not require the use of any electrical components, but rather can be operated entirely upon pnuematic controls. This is particularly useful in many situations in which a source of electricity is not readily available.

An apparatus according to the present invention also benefits from being simple and elegant in design. Such simple and elegant design leads to long life and reduced maintenance requirements. The present invention also results in a compact apparatus with a durable construction. It also requires a minimal number of moving parts, remixing in long life. The apparatus is suitable for use with a high energy/low air consumption nozzle arrangement and is highly portable for on-site cleaning. The device is easily operated and is economical in operation, maintenance, and construction.

While the invention has been disclosed in preferred forms, it will be apparent to those skilled in the art that many modifications, additions, and deletions can be made therein without departing from the spirit and scope of the invention as set forth in the following claims.

What is claimed is:

1. A particle blast cleaning apparatus for use with sublimable blast media, a source of compressed gas, and a discharge nozzle, said apparatus comprising:

mixing means for mixing sublimable media with compressed gas, said mixing means including:

a lower section having an outlet port formed therein;

an upper section positioned over and spaced apart from said lower section and having two sublimable media inlet ports and a compressed gas inlet port aligned with said outlet port of said lower section and positioned between said sublimable media inlet ports; and a reciprocating transfer member slidably mounted between a first bearing strip attached to said upper section and a second beating strip attached to said lower section for reciprocal movement, and having at least two transfer chambers for receiving sublimable media from said sublimable media inlet ports and for transporting the sublimable media to adjacent said outlet port.

2. An apparatus as claimed in claim 1 wherein said transfer chambers are generally tapered from a first opening near a top end portion thereof to a smaller, second opening near a bottom portion thereof to ease introduction of sublimable media into said transfer chambers with said transfer chambers adjacent said inlet ports.

3. An apparatus as claimed in claim 1 wherein said transfer chambers are generally circular in cross section at a bottom end portion thereof and are generally ovoid near a top portion thereof to ease introduction of sublimable media into said transfer chambers with said transfer chambers adjacent said inlet ports.

4. An apparatus as claimed in claim 1 wherein said first bearing strip and said second bearing strip further comprise means for venting pressure from said transfer chambers to ease introduction of sublimable media into said transfer chambers.

5. An apparatus as chimed in claim 4 wherein said means for venting pressure comprises pressure relief ports in said first bearing strip positioned between each of said sublimable media inlet ports and said compressed gas inlet port.

6. An apparatus as claimed in claim 1 and comprising means for relieving pressure in said transfer chambers.

7. An apparatus as claimed in claim 1 wherein said first bearing strip and said second bearing strip are fixed to said upper section and said lower section by means of mortises formed in said upper and lower sections.

8. An apparatus as claimed in claim 1 further comprising dynamic seal means for providing a fluid seal between said reciprocating transfer member and said second bearing strip of said lower section and between said reciprocating transfer member and said first bearing strip of said upper section, said dynamic seal means comprising guide means for movably locating said upper section relative to said lower section to maintain .said upper section in a substantially parallel, spaced apart relationship relative to said lower section, said dynamic seal means further comprising means for resilently urging said upper section towards said lower section.

9. An apparatus as claimed in claim 8 wherein said means for resilently urging said upper section towards said lower section comprises at least one air cylinder mounted to said upper and lower sections for urging said upper and lower sections toward each other.

10. An apparatus as claimed in claim 9 further comprising means for regulating air pressure supplied to said at least one air cylinder mounted to said upper and lower sections.

11. An apparatus as claimed in claim 1 further comprising pressure relief means communicating with said transfer chambers for venting pressure in said transfer chambers when said transfer chambers are not in alignment with said compressed gas inlet port.

12. An apparatus as claimed in claim 1 further comprising first means for moving said reciprocating transfer member in a first direction and second means for moving said reciprocating transfer member in a second direction, opposite said first direction, wherein said first and second means for moving comprise air cylinders adapted for pulling only.

13. An apparatus as claimed in claim 1 further comprising control means for switching between an air-only mode of operation and an air-plus-$CO_2$-pellets mode of operation.

14. A particle blast cleaning apparatus for use with sublimable blast media, a source of compressed gas, and a discharge nozzle, said apparatus comprising:

mixing means for mixing sublimable media with compressed gas, said mixing means including:

a lower section having an outlet port formed therein;

an upper section positioned over and spaced apart from said lower section and having two sublimable media inlet ports and a compressed gas inlet port;

a reciprocating transfer member mounted between said lower section and said upper section for reciprocal movement and having at least two transfer chambers for receiving sublimable media from said sublimable media inlet ports and for transporting the sublimable media to adjacent said outlet port; and pneumatic control means for adjusting the pressure of compressed gas supplied by said source of compressed gas to said mixing means.

15. An apparatus as claimed in claim 14 wherein said reciprocating transfer member is slidably located between an upper bearing strip and a lower bearing strip.

16. An apparatus as claimed in claim 15 wherein said upper bearing strip and said lower bearing strip further comprise means for venting pressure from said transfer chambers.

17. An apparatus as claimed in claim 15 wherein said upper beating strip and said lower bearing strip are fixed to said upper section and said lower section by means of mortises formed in said upper and lower sections.

18. An apparatus as claimed in claim 14 and comprising means for relieving pressure in said transfer chambers to facilitate introduction of sublimable media into said transfer chambers.

19. An apparatus as claimed in claim 14 wherein said pneumatic control means are operative for switching between an air-only mode of operation and an air-plus-$CO_2$-pellet mode of operation.

* * * * *